United States Patent [19]

Sigg et al.

[11] Patent Number: 4,750,425

[45] Date of Patent: Jun. 14, 1988

[54] SABOT PROJECTILE WITH A SABOT TAIL TO WHICH AN ATTACHMENT SLEEVE IS FASTENED THROUGH A REFERENCE FRACTURE LOCATION

[75] Inventors: Hanspeter Sigg, Jestetten, Fed. Rep. of Germany; Harald Katzmann, Neuenhof, Switzerland

[73] Assignee: Werkzeugmaschinenfabrik Oerlikon-Bührle AG, Zürich, Switzerland

[21] Appl. No.: 26,153

[22] Filed: Mar. 16, 1987

[30] Foreign Application Priority Data

Mar. 21, 1986 [CH] Switzerland ..... 01152/86

[51] Int. Cl.[4] ..... F42B 4/00

[52] U.S. Cl. ..... 102/357; 102/351; 102/520; 102/523

[58] Field of Search ..... 102/351, 357, 518, 520, 102/523

[56] References Cited

U.S. PATENT DOCUMENTS

| | | | |
|---|---|---|---|
| 3,927,618 | 12/1975 | Engel | 102/522 |
| 4,236,451 | 12/1980 | Galluzzi | 102/351 |
| 4,280,408 | 7/1981 | Weber et al. | 102/518 X |
| 4,296,687 | 10/1981 | Garrett | 102/523 X |
| 4,351,094 | 9/1982 | Haberli | 102/521 X |
| 4,505,204 | 3/1985 | Wikstrom | 102/523 |
| 4,648,324 | 3/1987 | McDermott | 102/518 |

FOREIGN PATENT DOCUMENTS

| | | |
|---|---|---|
| 0104587 | 4/1984 | European Pat. Off. . |
| 3131540 | 3/1983 | Fed. Rep. of Germany . |
| 2238137 | 2/1975 | France . |
| 2401399 | 3/1979 | France . |

*Primary Examiner*—Peter A. Nelson

*Attorney, Agent, or Firm*—Werner W. Kleeman

[57] ABSTRACT

It is important with a sabot projectile to reliably fasten the projectile core or body in the sabot tail. This should be achieved without the need for circumferential grooves in the projectile core or body for fastening such projectile core or body in the sabot tail. Furthermore, the projectile core or body should be fastened in the sabot tail without the aid of the sabot jacket. This is achieved in that an attachment or fastening sleeve of the sabot tail extends to the substantially conical-shaped tip of the projectile core or body and bears against this substantially conical-shaped tip in order to prevent the projectile core or body from falling out of the sabot tail.

4 Claims, 1 Drawing Sheet

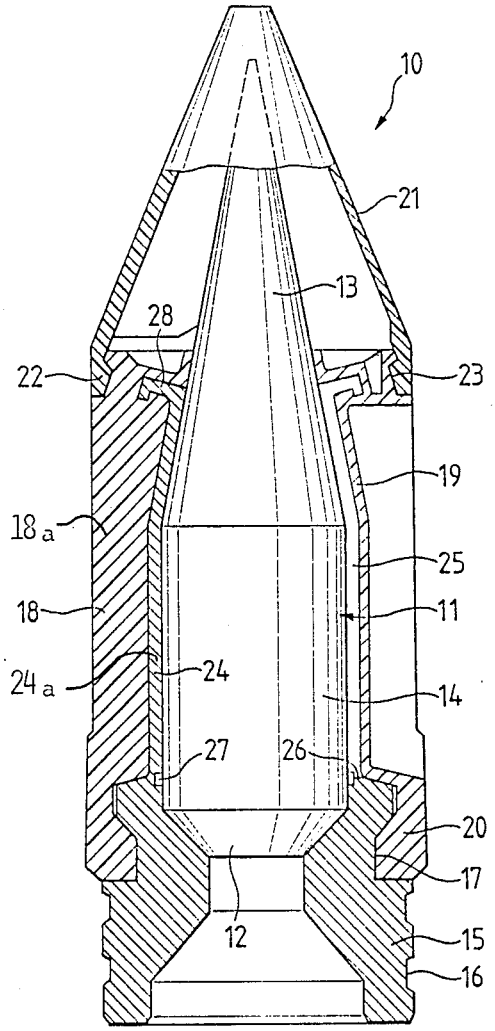
10
21
13
28
22
23
19
18 a
25
18
11
24 a
24
14
27
26
20
17
12
15
16

SABOT PROJECTILE WITH A SABOT TAIL TO WHICH AN ATTACHMENT SLEEVE IS FASTENED THROUGH A REFERENCE FRACTURE LOCATION

BACKGROUND OF THE INVENTION

The present invention relates to a new and improved construction of a sabot projectile.

In its more specific aspects, the present invention relates to a new and improved construction of a sabot projectile equipped with a sabot tail or tail portion at which an attachment or fastening sleeve is fastened by means of a reference fracture location. The attachment or fastening sleeve is subdivided into segments by slots. The sabot projectile possesses a projectile core or body exhibiting a substantially cylindrical intermediate or middle portion, a tapering or substantially conical-shaped tip and a substantially conical tail portion. The projectile core or body projects by means of its rear region or portion into the attachment or fastening sleeve of the sabot tail or tail portion. A sabot jacket is anchored at the sabot tail or tail portion and surrounds the attachment or fastening sleeve and is subdivided by slots into segments.

With such type of prior art sabot projectile, for example, as generally known from Swiss Pat. No. 536,481, the projectile body or core exhibits a circumferential groove at its rear portion which projects into the attachment or fastening sleeve. Cams or dogs provided at the inside of the attachment or fastening sleeve and which are radially inwardly directed, are arranged so as to protrude into the circumferential groove. These cams or dogs are formed of one piece or integrally with the attachment or fastening sleeve.

The circumferential groove provided in this known projectile body or core is disadvantageous since it increases the air resistance in an undesired manner.

With another known construction of sabot projectile of this type, as disclosed in British Pat. No. 576,217, the sabot comprises two portions which are connected with each other across a reference fracture location. Both of these two portions can be shifted or displaced relative to each other under the action of inertial forces when the projectile is fired. The projectile body or core is supported on the rear portion of the sabot and the front portion of the sabot bears or rests against the tip of the projectile body and consists of segments which fall apart and release the projectile core or body when the sabot leaves the weapon barrel muzzle.

This other known construction of sabot projectile has the disadvantage that the sabot tail must either be constructed in two parts or portions so that the projectile core or body can be fastened in the sabot tail or the sabot jacket must be used for fastening the projectile core or body at the sabot tail.

SUMMARY OF THE INVENTION

Therefore, with the foregoing in mind it is a primary object of the present invention to provide a new and improved construction of a sabot projectile which is not afflicted with the aforementioned drawbacks and shortcomings of the prior art constructions.

Another important object of the present invention aims at the provision of an improved construction of a sabot projectile in which the projectile core or body is fastened in the sabot tail or tail portion independently from the sabot jacket and without the need for the provision of circumferential grooves in the projectile core or body for fastening the projectile core or body in the sabot tail or tail portion, and wherein the sabot jacket makes no contribution to the attachment or fastening of the projectile core or body in the sabot tail or tail portion.

Yet a further significant object of the present invention relates to the provision of an improved attachment structure for connecting the projectile core or body with the sabot tail of a sabot projectile in a highly reliable and secure manner and without affecting the aerodynamic properties of the projectile body or core.

Now in order to implement these and still further objects of the invention which will become more readily apparent as the description proceeds, the sabot projectile of the present development is manifested by the features that the attachment or fastening sleeve of the sabot tail extends to the region of the tapering or substantially conical-shaped tip of the projectile core or body and bears or rests against this tapering or substantially conical-shaped tip, in order to prevent the projectile core or body from falling out of the sabot tail or tail portion.

This type of attachment or fastening of the projectile core or body at the sabot tail or tail portion has the advantage that the sabot tail or tail portion directly holds the projectile core or body without the aid of the sabot jacket, so that relatively light material can be used for fabrication of the sabot jacket.

BRIEF DESCRIPTION OF THE DRAWINGS

The invention will be better understood and objects other than those set forth above will become apparent when consideration is given to the following detailed description thereof. Such description makes reference to the annexed drawing wherein the single FIGURE shows a longitudinal section through the inventive sabot projectile.

DESCRIPTION OF THE PREFERRED EMBODIMENTS

Describing now the drawings, it is to be understood that to simplify the showing thereof only enough of the structure of the inventive sabot projectile has been illustrated therein as needed to enable one skill in the art to readily understand the underlying principles and concepts of the present invention. Turning now specifically to the single FIGURE of the drawing, there is depicted therein an exemplary embodiment of a sabot projectile 10 possessing a projectile core or body 11, preferably manufactured from heavy metal. This projectile core or body 11 possesses a substantially conical tail portion 12 and a tapering or substantially conical-shaped tip or front portion 13. The conical tail portion 12 and the tapering or substantially conical-shaped tip 13 are formed of one piece or integral with a substantially cylindrical intermediate or middle portion 14. The projectile core or body 11 fits at its rear portion or region into or is seated in a substantially ring-shaped sabot tail or tail portion 15, preferably made from light metal, especially aluminum.

The sabot tail or tail portion 15 possesses a number of exterior or outer circumferential grooves as will now be further explained. Specifically, there is provided a first circumferential groove 16 which essentially serves to anchor a not particularly depicted but conventional cartridge case filled with a suitable propellant charge.

There is also provided a second circumferential groove 17 which essentially serves to anchor or fasten a substantially sleeve-shaped sabot jacket 18, preferably made from plastic. This sleeve-shaped sabot jacket 18 consists of several segments, one of which has been generally indicated by reference character 18*a*, and connected to each other by thin webs 19. When the sabot projectile 10 is fired and departs from the weapon barrel muzzle, the sleeve-shaped sabot jacket 18 falls apart or detaches under the effect of the projectile spin and the individual segments 18*a* separate from each other along the thin webs 19. The sleeve-shaped sabot jacket 18 possesses at its rear end a rotating or spinner band 20 that projects into the aforementioned circumferential groove 17 of the sabot tail or tail portion 15 and serves as a seal against entry of the propellant gases as well as to anchor the sleeve-shaped sabot jacket 18 at the sabot tail or tail portion 15.

At the front end of the sleeve-shaped sabot jacket 18 there is fastened a protective hood or cover 21, preferably fabricated of plastic and anchored by means of a bead or connection portion 22 in a circumferential groove 23 of the sleeve-shaped sabot jacket 18. The sabot tail or tail portion 15 is provided with an attachment or fastening sleeve 24 which rests or bears against the cylindrical intermediate or middle portion 14 and partially against the tapering or substantially conical-shaped tip 13 of the projectile core or body 11. The attachment or fastening sleeve 24 is subdivided by a number of slots 25 into segments, generally indicated by reference character 24*a*, which are fastened to the sabot tail or tail portion 15 by means of or across a reference fracture location or means 26. This reference fracture location 26 is formed by an inner circumferential groove 27 which is so deep that when the sabot projectile 10 is fired, the individual segments 24*a* of the attachment or fastening sleeve 24 break-up under the effect of the projectile spin.

At the front end, the attachment or fastening sleeve 24 possesses a ring or ring member 28 which is anchored in the sleeve-shaped sabot jacket 18. This ring or ring member 28 is likewise divided into individual segments by the aforementioned slots 25. For inserting the projectile core or body 11 into the sabot tail or tail portion 15 and into the therewith integrated attachment or fastening sleeve 24, the individual segments 24*a* of the attachment or fastening sleeve 24 can be radially bent or spread apart to such an extent that the projectile core or body 11 can be inserted from the front into the attachment or fastening sleeve 24.

While there are shown and described present preferred embodiments of the invention, it is to be distinctly understood that the invention is not limited thereto, but may be otherwise variously embodied and practiced within the scope of the following claims. Accordingly,

What we claim is:

1. A sabot projectile, comprising:

a sabot tail provided with reference fracture location means;

an attachment sleeve integrally fastened by means of said reference fracture location means at said sabot tail;

said reference fracture location means being located between said sabot tail and said attachment sleeve;

a projectile core possessing a substantially cylindrical intermediate portion, a substantially conical-shape tip and a tail portion at the region of a rear portion of the projectile core;

said projectile core projecting with said rear portion into said attachment sleeve of said sabot tail;

a sabot jacket anchored at said sabot tail;

said sabot jacket surrounding said attachment sleeve; and said attachment sleeve of said sabot tail extending up to the region of said substantially conical-shaped tip of said projectile core and bearing against said substantially conical-shaped tip, in order to prevent said projectile core from falling-out of said sabot tail.

2. A sabot projectile, comprising:

a sabot tail provided with reference fracture means;

an attachment sleeve fastened by means of said reference fracture means at said sabot tail;

said attachment sleeve being divided into segments by means of slots;

said reference fracture means being located between said sabot tail and said attachment sleeve;

a projectile core possessing a substantially cylindrical intermediate portion, a substantially conical-shaped front portion and a tail portion at the region of a rear portion of said projectile core;

said projectile core being seated at said rear portion in said attachment sleeve of said sabot tail;

a sabot jacket anchored at said sabot tail;

said sabot jacket surrounding said attachment sleeve and being divided into segments by slots; and said attachment sleeve of said sabot tail extending up to the region of said substantially conical-shaped front portion of said projectile core and bearing against said substantially conical-shaped front portion, in order to prevent said projectile core from falling-out of said sabot tail.

3. A sabot tail provided with reference fracture means;

an attachment sleeve fastened by means of said reference fracture means at said sabot tail;

said attachment sleeve being divided into segments by means of slots;

a projectile core possessing a substantially cylindrical intermediate portion, a substantially conical-shaped front portion and a tail portion at the region of a rear portion of said projectile core;

said projectile core being seated at said rear portion in said attachment sleeve of said sabot tail;

a sabot jacket anchored at said sabot tail;

said sabot jacket surrounding said attachment sleeve and being divided into segments by slots;

said attachment sleeve of said sabot tail extending up to the region of said substantially conical-shaped front portion of said projectile core and bearing against said substantially conical-shaped front portion, in order to prevent said projectile core from falling-out of said sabot tail; and said attachment sleeve and said sabot tail are integrally formed with one another.

4. The sabot projectile as defined in claim 2, wherein:

said attachment sleeve of said sabot tail serving to secure said projectile core in the sabot tail independently of the sabot jacket.

* * * * *